US011124938B2

(12) United States Patent
Almy et al.

(10) Patent No.: US 11,124,938 B2
(45) Date of Patent: Sep. 21, 2021

(54) EXPANDING FOUNDATION COMPONENTS AND RELATED SYSTEMS AND METHODS

(71) Applicant: Ojjo, Inc., San Rafael, CA (US)

(72) Inventors: Charles Almy, Berkeley, CA (US); Theodore Gittings, Novato, CA (US)

(73) Assignee: Ojjo, Inc., San Rafael, CA (US)

( * ) Notice: Subject to any disclaimer, the term of this patent is extended or adjusted under 35 U.S.C. 154(b) by 0 days.

(21) Appl. No.: 16/560,945

(22) Filed: Sep. 4, 2019

(65) Prior Publication Data

US 2020/0071901 A1 Mar. 5, 2020

Related U.S. Application Data

(60) Provisional application No. 62/726,909, filed on Sep. 4, 2018.

(51) Int. Cl.

| | |
|---|---|
| ***E02D 5/22*** | (2006.01) |
| ***E02D 5/44*** | (2006.01) |
| ***E02D 7/00*** | (2006.01) |
| ***E02D 23/00*** | (2006.01) |
| ***E02D 5/52*** | (2006.01) |

(52) U.S. Cl.
CPC ..... *E02D 5/523* (2013.01); *E02D 2200/14* (2013.01)

(58) Field of Classification Search
CPC .... E02D 5/54; E02D 5/22; E02D 5/44; E02D 7/00; E02D 23/00; E02D 5/523; E02D 2200/14
See application file for complete search history.

(56) References Cited

U.S. PATENT DOCUMENTS 1,598,300 A * 8/1926 Moran ..... E02D 3/10 405/271
1,690,383 A * 11/1928 Thomson ..... E21B 33/128 277/338
1,802,786 A * 4/1931 Smith ..... E21B 43/12 166/138
1,975,390 A * 10/1934 Davic ..... E21B 33/12 277/338
2,021,223 A * 11/1935 Church ..... E21B 33/129 166/124
2,558,529 A * 6/1951 Thornley ..... E02D 5/48 405/245
2,631,435 A * 3/1953 Emshwiller ..... E02D 5/54 405/244
2,906,346 A * 9/1959 Johnston ..... E21B 43/10 166/214

(Continued)

*Primary Examiner* — Edwin J Toledo-Duran
(74) *Attorney, Agent, or Firm* — Phillip D. Mancini; Ojjo, Inc.

(57) ABSTRACT

A foundation component having an elongated shaft with a below-ground end and an opposing above-ground end. The foundation component is installed by sleeving it over a mandrel and applying downward force to the mandrel to insert the component and mandrel into underlying soil. Proximate to the underground end, the shaft has one or more crumple zones formed along its length. When the mandrel is rotated to a locked position and upward force is applied while bracing the above-ground end of the component, one or more of the crumple zones expand transversely into the soil, depending on the soil's density, thereby increasing the component's bearing capacity and resistance to pull out.

10 Claims, 12 Drawing Sheets

(56) References Cited

U.S. PATENT DOCUMENTS 3,277,968 A * 10/1966 Grimaud ..... E02D 5/56 173/216
3,438,578 A * 4/1969 Moyer ..... A47G 21/186 239/33
3,716,649 A * 2/1973 Smith ..... H01R 4/66 174/7
3,971,227 A * 7/1976 Godley ..... E02D 5/72 405/233
4,009,582 A * 3/1977 LeCorgne ..... E02D 5/385 405/240
4,470,171 A * 9/1984 Rusmussen ..... A22C 11/02 138/120
4,571,126 A * 2/1986 Granstrom ..... E02D 5/805 405/244
5,033,549 A * 7/1991 Champeaux ..... E21B 43/08 166/278
5,115,860 A * 5/1992 Champeaux ..... E21B 43/08 166/278
5,622,015 A * 4/1997 Collins ..... E02D 5/80 405/231
5,975,808 A * 11/1999 Fujita ..... E02D 5/28 405/244
6,315,040 B1 * 11/2001 Donnelly ..... E21B 43/084 166/207
6,662,873 B1 * 12/2003 Nguyen ..... C04B 28/02 166/276
7,004,685 B2 * 2/2006 Creed ..... E02D 5/54 405/230
9,181,759 B1 * 11/2015 Yusuf ..... E21B 33/14
2003/0024708 A1 * 2/2003 Ring ..... E21B 17/042 166/380
2003/0178200 A1 * 9/2003 Fox ..... E21B 19/146 166/341
2004/0247397 A1 * 12/2004 Fox ..... E02D 5/46 405/248
2004/0251033 A1 * 12/2004 Cameron ..... E21B 43/086 166/382
2007/0077128 A1 * 4/2007 Wissmann ..... E02D 3/08 405/232
2008/0115944 A1 * 5/2008 Coon ..... E21B 33/12 166/387
2008/0193223 A1 * 8/2008 Wissmann ..... E02D 5/72 405/229
2010/0044029 A1 * 2/2010 Lynde ..... E21B 43/105 166/206
2012/0088407 A1 * 4/2012 Natoli ..... H01R 24/564 439/585
2012/0165918 A1 * 6/2012 Du ..... A61F 2/07 623/1.15
2015/0068743 A1 * 3/2015 Broussard ..... E21B 33/126 166/278
2015/0132539 A1 * 5/2015 Bailey ..... C23C 16/0254 428/141
2015/0330051 A1 * 11/2015 White ..... E02D 27/18 405/249
2016/0281501 A1 * 9/2016 Bin Muhammad Moizuddin ..... G01N 33/24

* cited by examiner

EXPANDING FOUNDATION COMPONENTS AND RELATED SYSTEMS AND METHODS

CROSS-REFERENCE TO RELATED APPLICATIONS

This claims priority to U.S. provisional patent application No. 62/726,909 titled "Foundation piers for axial solar arrays and related systems and methods", filed on Sep. 4, 2018, the disclosure of which is hereby incorporated by reference in its entirety.

BACKGROUND

Below-ground foundations utilize the bearing capacity of soil to support above-ground structures. Buildings, decks, signs, fences and other structures continue to be supported with this age-old technique. One common method of constructing ground-supported foundations is impact pile driving. With impact pile driving, the beam, strut, post or other foundation component is held in place, usually at a plumb orientation, while a weighted hammer repeated strikes the top end causing it to incrementally embed into the underlying ground. Components driven by impact pile driving usually have a uniform geometry along the driving axis because any transverse elements with significant orthogonal surface area will strongly resist driving. Even if these features can be driven, they will carve out a trench as they go down, preventing the component from securely embedding in the soil. Unfortunately, features that area orthogonal to the driving axis have much greater bearing capacity then uniform members driven to the same depth.

Another common foundation technique is to use poured concrete footers. With this technique a hole is excavated at the desired foundation location that has an enlarged diameter. Then, the foundation component is placed in the hole and at least a portion of it is filled with cement. When the cement dries, soil may be backfilled and tamped over the it. The cement adds weight and widens the orthogonal cross section of the foundation component substantially increasing the component's ability to resist axial forces. Also, because a hole is excavated first, foundation components with larger below-ground features and orthogonal surface geometries can be used. Although this method is effective, it requires several additional process steps relative to pile driving including mixing, transporting and pouring heavy concrete, and waiting for the concrete to set that make it more expensive and time consuming.

Another solution that solves some of the shortcomings of impact pile driving and poured concrete foundations is helical anchors. A helical anchor is an elongated foundation component with one or more helical flights or external thread forms that are driven with a combination of downforce and torque. The helix and/or threads help pull the component down and, once driven, provide increased orthogonal surface area to resist axial forces. This technique is also effective but requires a machine that can impart torque as well as downforce and may require pre-drilling in certain soils to prevent the threads or flight from auguring the soil.

Still a further option is to drive something a deployable cable anchor that changes its geometry once the strut is driven below ground by applying tension to the cable. Once the driven foundation component reaches its target depth, a separate device is used to tension the cable causing the previously axially oriented component to take on an orthogonal geometry. The tensioned cable is secured then secured to the above ground of the component to prevent it from returning to an axial orientation when tension is put on the pile. Cable anchors can provide a great deal of resistance, but they require additional tools to deploy the anchor as well as a mechanism for securing the tensioned cable.

All of these prior art methods for increasing the bearing resistance of a foundation component suffer from one or more disadvantages as discussed above. Accordingly, it is an object of the various embodiments of the invention to provide a foundation component that overcomes some or all of the limitations of prior art methods and that can be easily driven and deploy underground features that increase the component's resistance to axial forces using the same machine used to drive it and in the same driving step.

DESCRIPTION

Resistance to axial forces of tension and compression in single foundation members is dictated by the bearing capacity of the soil or surrounding medium and skin friction on the surface. Below ground features that increase the surface area or outside diameter of the foundation member that are normal to its main axis provide greater resistance to axial forces than uniform beams, posts, and piers relying mostly on skin friction. This is why concrete footers, helical anchors, and cable anchors are frequently used to support heavy structures such as retaining walls, building foundations, light posts, etc. as well as structures that can generate large tensile forces like communication towers and poles. In addition to adding weight, these features increase the orthogonal surface area of the foundation component creating a cone of soil resistance that must be displaced to dislodge the component.

In this light of this, various embodiments of the invention provide a foundation system that relies on a mandrel driver and mandrel and attached to piece of portable equipment that drives below-ground foundation components and deploys transverse features. The mandrel driver may be electrically or hydraulically powered and may be an attachment for a piece of general-purpose heavy equipment (e.g., skid-steer, backhoe, tractor, excavator, etc.) or special-purpose machine. Heavy equipment is well known in the art and therefore has been intentionally omitted from the disclosure. The various embodiments of the invention are not dependent on a particular brand or style of equipment as long as it can physically support the mandrel driver and provide operating power (e.g., hydraulic, electric, air, etc.) mandrel driver as well as downforce.

Figure 1A:
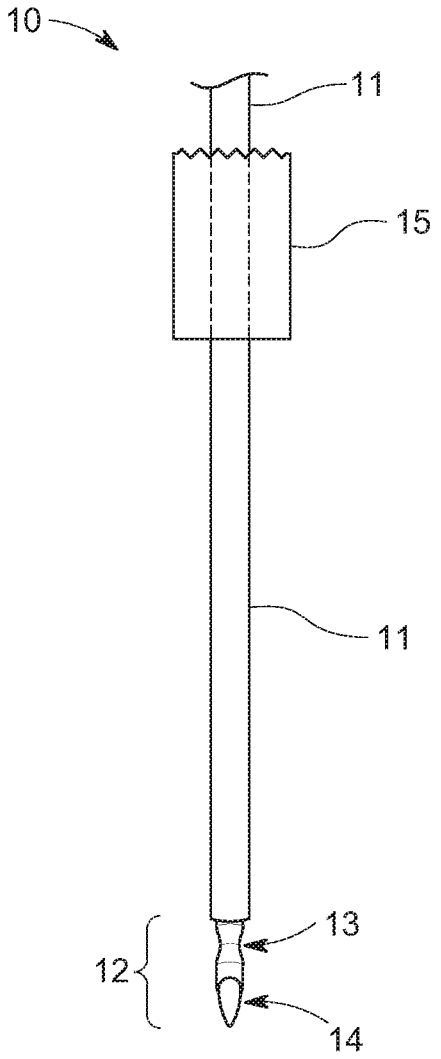
FIG. 1A is a front view of a mandrel according to various embodiments of the invention.
Figure 1B:
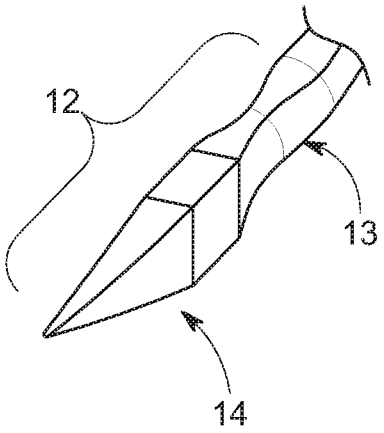
FIG. 1B is a perspective view of a tip portion of a mandrel according to various embodiments of the invention.

Referring now to FIGS. 1A and B, these figures show different views of mandrel 10 usable with various embodiments of the invention. Mandrel 10 is a two-stage mandrel that has a main shaft or body portion 11 that is shown in the exemplary figure as having a substantially uniform outer diameter. It may be formed from solid hardened steel or other suitable material. A larger diameter slide portion 15 surrounds shaft 11 and is able to move with shaft 11 or to remain fixed while shaft 11 moves independently. Distal end portion 12 may include tip 14 and collar portion 13. In various embodiments, end portion 12 may be removable from shaft 11 to replace and/or repair it. For example, end portion 12 may have a male or female threaded portion that mates with a reciprocal threaded portion formed in the end of shaft 11. The geometry of end portion 12 is shown in greater detail in 1B. Tip 14 is relatively narrower in one dimension and relatively thicker in the other, orthogonal dimension, while collar portion 13 tapers in and out uniformly to and from a section of minimum diameter. As discussed in greater detail in the context of FIGS. 2A-C below, this geometry may provide certain advantages when used with the foundation member according to various embodiments of the invention. The mandrel driver may simply exert down force on shaft 11 and slide 15 or may apply a hammering force in combination with down force to drive mandrel 11 and an attached foundation component into underlying ground.

Figure 2A:
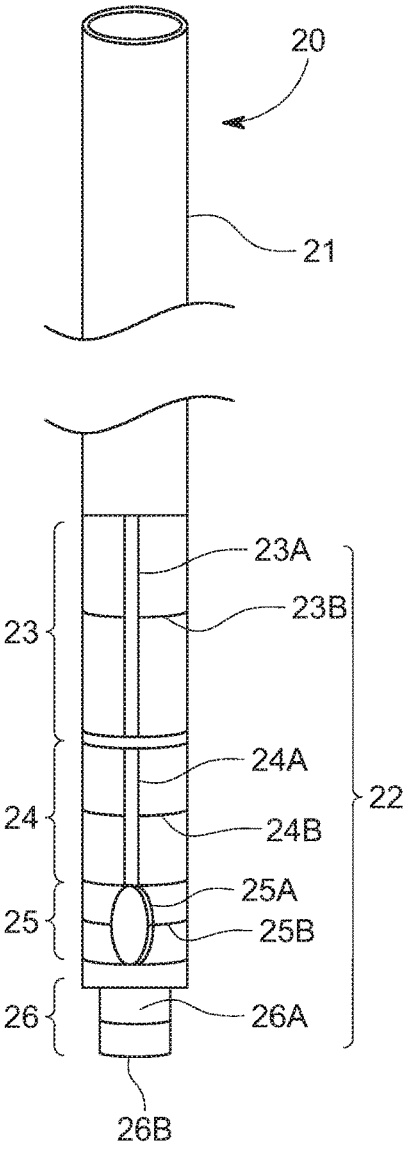
FIGS. 2A-C are various view of a foundation component according to various embodiments of the invention.
Figure 2B:
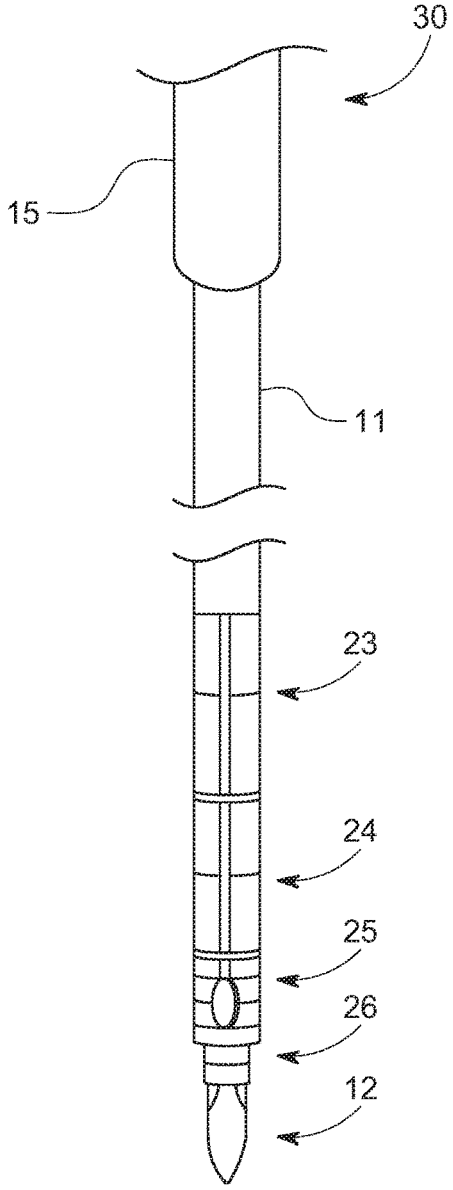
Figure 2C:
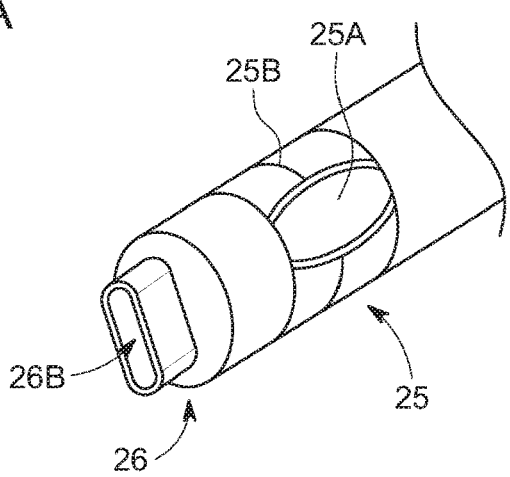

Referring now to FIGS. 2A-C, these figures show elements of exemplary foundation component 20 (pier, pile, post, strut, etc.) according to various embodiments of the invention. Component 20 is an elongated tubular member having a hollow shaft with an upper end 21 and an opposing lower end 26. The member is preferably open at both ends. The shaft is substantially uniform in diameter until lower end 26 that terminates in a substantially rectangular-shaped opening 26B with rounded edges that may be formed by swaging or with some other known deforming process. Alternatively, lower end 26 may be formed separately and welded on to the end of component 20. As discussed in greater detail in the context of the remaining figures, the geometry shown in these figures allows an asymmetric mandrel the tip to fit through opening 26B at one orientation but captures it at another.

Moving away from lower end 26, there begins region 22 of successive crumple zones 25, 24, 23 along the shaft. Each crumple zone 25, 24, 23 comprises a plurality of holes or openings 25A, 24A, 23A, that are longer in the direction of the main axis of component 20 than in the transverse direction. In various embodiments, these openings are repeated all the way around the component, dividing it into multiple crumple sections (e.g., two, three, four, etc.). In various embodiments, each crumple zone may be separated from the next by a spacer—a continuous section of the pipe or tube. This may be desirable to prevent the deformation of one crumple zone affecting the adjacent crumple zone. Also, as shown, each crumple zone has crumple lines 25B, 24B, 23B orthogonal to the axis of the shaft interconnecting each opening at approximately the midpoint of the opening and bounding the start and stop of the crumple zone. After component 20 is driven into a supporting medium, such as soil, sand, etc., the combination of openings 25A, 24A, 23A and crumple lines 25B, 24B, 23B will cause each section of the crumple zone to fold about the crumple lines, roughly folding each zone in half and anchoring into the surrounding soil to form a series of orthogonal anchors distributed around foundation component 20. As discussed in greater detail herein, the extent to which each crumple zone or section anchors into the surrounding earth after compression will be roughly one half the length of the opening or one half the length of that crumple zone.

In various embodiments, the length of the crumple zones increases moving away from lower end 26 as reflected by the increasing length of the openings 25A, 24A, 23A of each successive crumple zone 25, 24, 23. At the same time, the width of these openings decreases, requiring relatively more pressure to deploy because more material must be bent and forced deeper into the surrounding soil. For a given level of soil density, the smallest crumple zone with the widest opening will be easier to crumple than the longer zones with smaller ones. At the same time, because the length of the crumple zone gets increasingly larger moving away from below-ground end 26, denser soils such as clay will prevent the larger crumple zones from deploying (e.g., anchoring) because they displace more soil. By contrast, in less dense soils, such as sand or silt, the same amount of compressive pressure will cause multiple ones of the crumple zones to deform, and preferably all of them, thereby increasing the orthogonal surface area of component 20 and its resistance to axial forces.

Figure 3A:
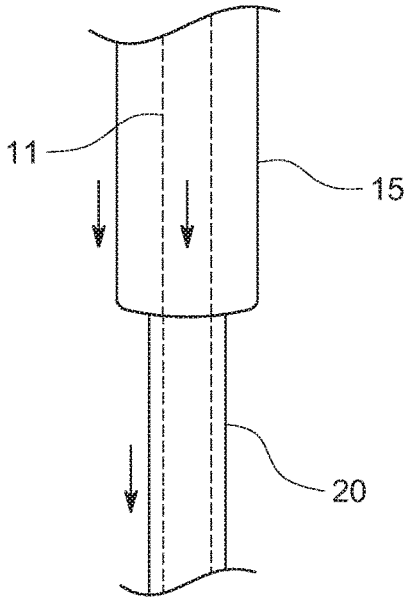
FIGS. 3A-3E show stages of foundation component installation according to various embodiments of the invention.
Figure 3B:
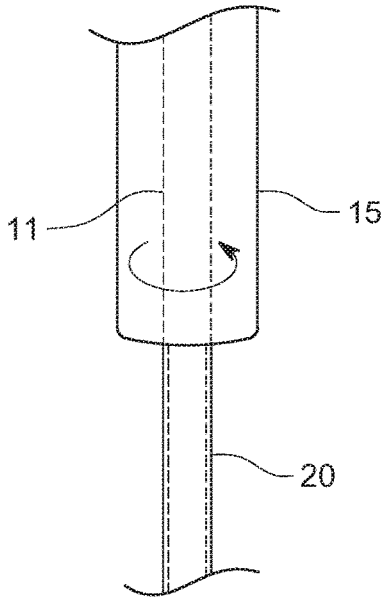
Figure 3C:
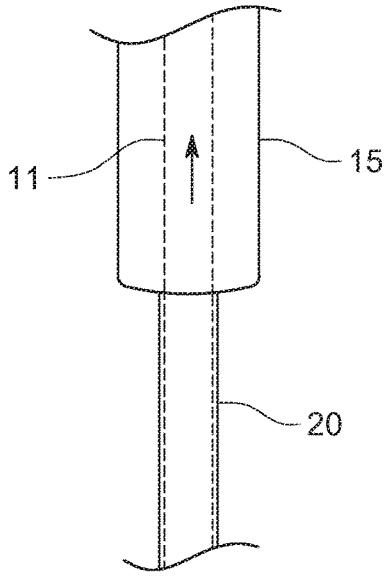
Figure 3D:
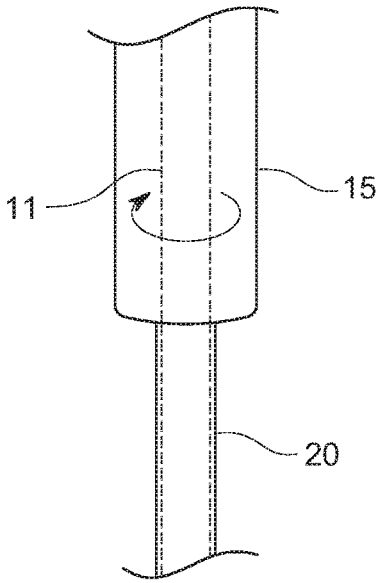
Figure 3E:
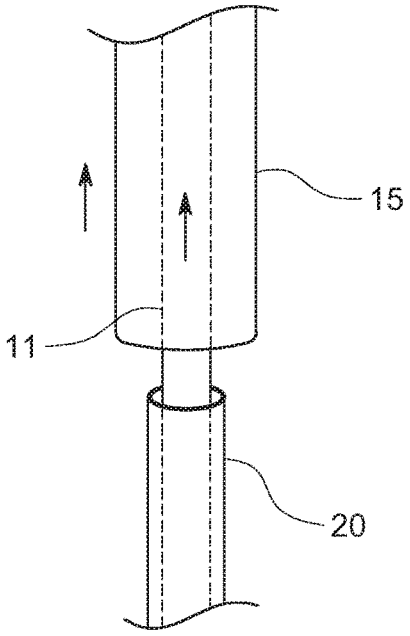

Turning to FIGS. 3A-E, these figures show the motion of the mandrel with respect to component 20 during the stages of installation and anchor deployment according to various exemplary embodiments of the invention. Component 20 is loaded onto mandrel 11 of assembly 10 by sleeving component 20 over the mandrel until tip portion 12 exists the bottom end. Component 20 may need to be rotated so that opening 26 is at the correct orientation to allow mandrel tip portion 12 to pass through. Narrowed collar portion 13 of mandrel 11 provides clearance for tip portion 12 to rotate within swaged opening 26B, effectively coupling the mandrel and strut together as an assembly for driving. Once through, a set screw, pin or other device may be passed through component 20, mandrel 11 and even slide 15 to capture it. Alternatively, or in addition, slide portion 15 may be adjusted to rest against the head of component 20. In various embodiments, slide 15 will be adjustable with respect to mandrel 11 to accommodate foundation components of different lengths. Slide 15 may have a narrower collar portion (not shown) that fits within the open end of component 20 around mandrel 11 to provide additional support component 20 to prevent it from buckling or otherwise deforming in response to driving forces. As shown in 3A, mandrel 11 and slide 15 exert downward pressure onto component 20. Downward pressure may be provided by a mandrel driver, by the equipment the mandrel driver is attached to, or a combination of these. In various embodiments, mandrel 11 is pulls down from end portion 26 while slide 15 pushes on the opposing end of component 20. In FIG. 3B, component 20 has been driven to the desired depth. Mandrel 11 is then rotated independent of component 20. This may require withdrawing a pin or releasing a set screw holding component 20 to mandrel 11. This may also require pulling up slightly on mandrel 11 until it moves a known distance relative to component 20 so that narrowed collar portion 13 is positioned within opening 26B. Rotating the mandrel will change the orientation of component 20 with respect to tip portion 12 so that tip portion 12 no longer fits through opening 26B. Then, as shown in 3C, upward force is applied to mandrel 11 while slide 15 braces the upper end of component 20 to prevent it from being pulled out of the ground. In various embodiments, a fixed amount of pulling force is applied (e.g., 3000 pounds). The amount of force may be the same each time, may be determined based force measurements made during driving, or may be set manually by an operator based on known or perceived soil conditions. In some cases, the mandrel will reach a limit where continued application of the pulling forces fails to result in additional lift. Alternatively, the mandrel may continue to move up until it has traveled a predetermined maximum distance. In still further embodiments, the pulling force may be applied for a fixed period of time. In any case, the pulling force is then relaxed, and the mandrel is rotated back to unlock it from opening 26B as shown in 3D. Again, it may be necessary to push down slightly on the mandrel to orient collar portion 13 within opening 26B prior to rotating back. Then, as shown in 3E, mandrel 11 and slide 15 are both pulled up, leaving component 20 anchored in the ground. In looser soils it may be advantageous to brace the top end of component 20 with slide 15 until the mandrel has cleared opening 26B.

Figure 4A:
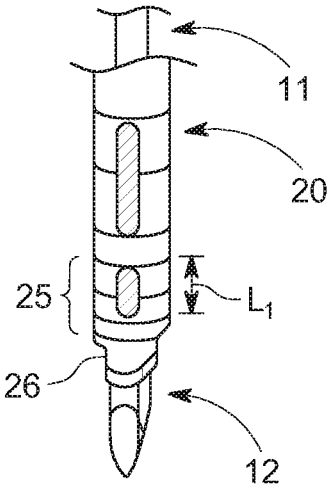
FIGS. 4A-C show stages of anchor deployment of a foundation component according to various embodiments of the invention.
Figure 4B:
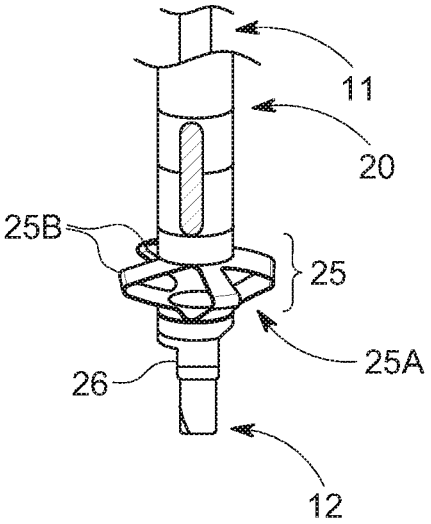
Figure 4C:
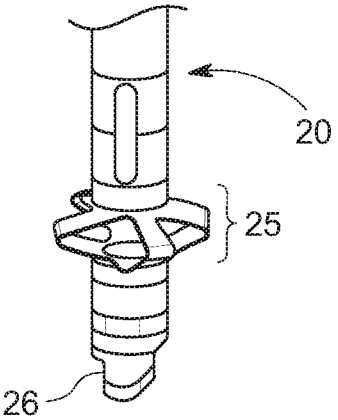

FIGS. 4A-C show various stages of crumple zone compression of foundation component 20 according to various embodiments of the invention. In the example of these figures, component 20 has been driven in relatively hard (i.e., high density) soil. FIG. 4A shows the configuration of mandrel 11 and component 20 while component is being driven. In various embodiments it remains at this configuration until the mandrel and component assembly reach the desired depth. Surrounding soil has been intentionally omitted from the figures. In 4B, mandrel 11 has been rotated to an orientation that captures it within end portion 26 and upward pressure is being applied. Though not shown, slide 15 is bracing the top end of component 20 to prevent the upward pressure from pulling component 20 out of the ground. As tip portion 12 of mandrel 11 presses against swaged opening 26B, axial force is applied to component 20. This in turn causes crumple zone 25 to begin to crumple, splaying outward into the surrounding soil to anchor component 20. In various embodiments, crumpling occurs about crumple lines 25B while openings 25A allow the metal to deform in a predictable way. In 4C, the pulling force is relaxed and mandrel 11 is unlocked from end 26. The mandrel is removed leaving behind embedded component 20 with crumple zone 25 anchored into the surrounding soil. This additional orthogonal surface area will greatly increase the ability of component to resist axial forces trying to further embed it or pull it out. Ideally, and as shown in 4C, upward pressure by mandrel 11 causing the four sections of crumple zone 25 to splay outward orthogonally to component 20 an approximate distance equal to one half the length of that crumple zone ($L_1$).

Figure 5A:
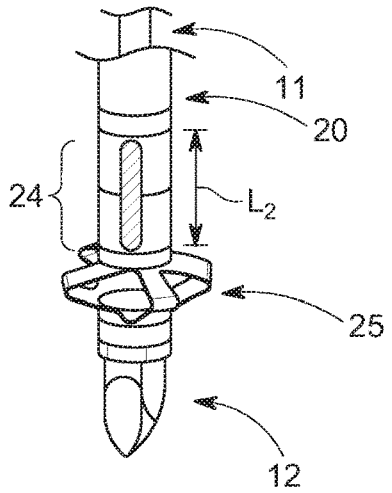
FIGS. 5A-C show stages of anchor deployment of a foundation component according to various other embodiments of the invention.
Figure 5B:
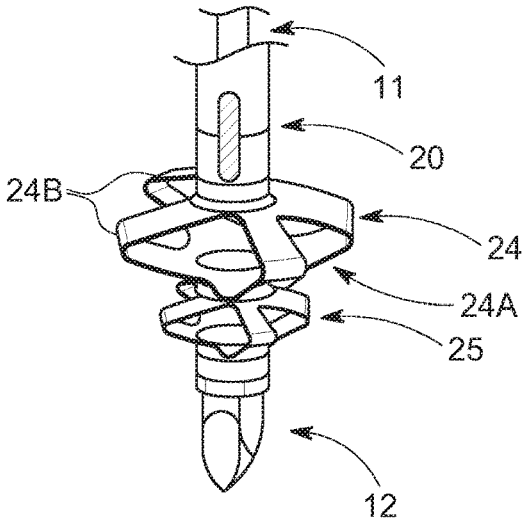
Figure 5C:
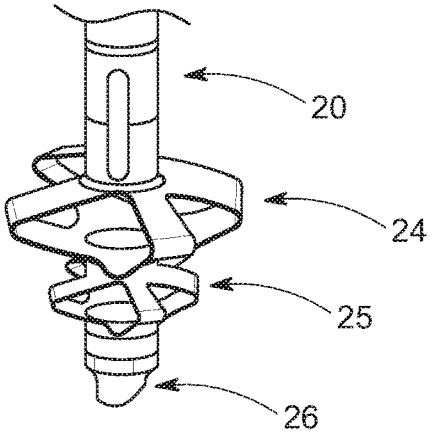

Referring now to FIGS. 5A-5C, these figures illustrate foundation component 20 according to various embodiments of the invention that has been driven and compressed in relatively soft soil as compared to that shown in FIGS. 4A-C. In softer soils, resistance to tension and compression is more difficult to achieve because the lower soil density reduces skin friction making it easier to pull out and/or push in below-ground foundation components. As a result, when piles/piers/posts/etc. are installed in such soils they have to be driven much deeper than in dense soil types in the absence of an anchor, concrete, or other orthogonal feature that enhances resistance to axial forces.

FIGS. 5A-C show stages of crumple zone compression in soil that is relatively less dense than that shown in FIGS. 4A-C. In these figures, both crumple zone 25 and crumple zone 24 have deployed. FIG. 5A starts with the image shown in 4B where the crumple zone 25 has deployed. In relatively softer soil, the same amount of compressive force on foundation component 20 will result in additional crumple zone deformation. This is reflected in FIG. 5B where crumple zone 25 and crumple zone 24 have been deformed by the upward pulling pressure from mandrel 11 combined with bracing by slide 15 on the top of component 20. The relatively larger crumple zone 24 will provide greater surface area orthogonal to the main axis of component 20 relative to zone 25, partially compensating for the lower density of the soil. Individual sections making up zone 24 will fold about crumple lines 24B causing the sections to splay outward, anchoring into the surrounding soil a distance approximately equal to one half of the length of crumple zone 24 ($L_2$). When the tension between mandrel 11 and foundation component 20 is released and mandrel 11 is rotated back to the unlocked position, it can be withdrawn from foundation component 20 leaving behind embedded component 20 with the deformed shape shown in FIG. 5C. The advantage of this system is that by applying a uniform degree of force, the strut will self-optimize, anchoring itself to a lesser or greater degree depending on the density of the soil; less dense soils will achieve more anchoring and denser soils will achieve less without needing to make changes to the driving/deployment process.

Figure 6A:
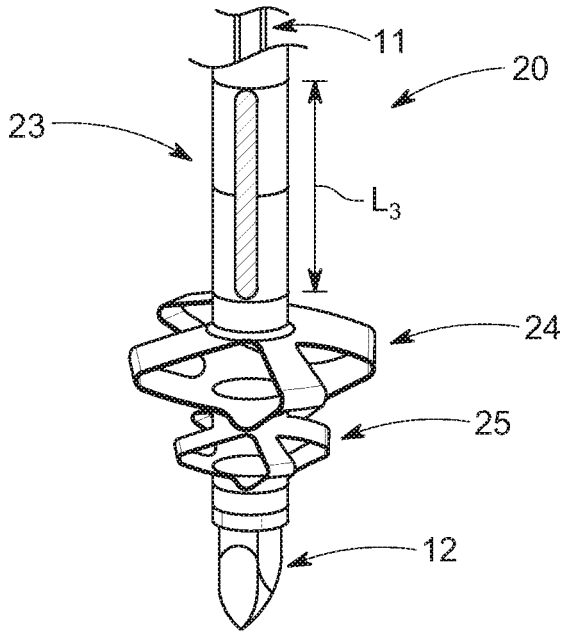
FIGS. 6A-C, show stages of anchor deployment of a foundation component according to various additional embodiments of the invention.
Figure 6B:
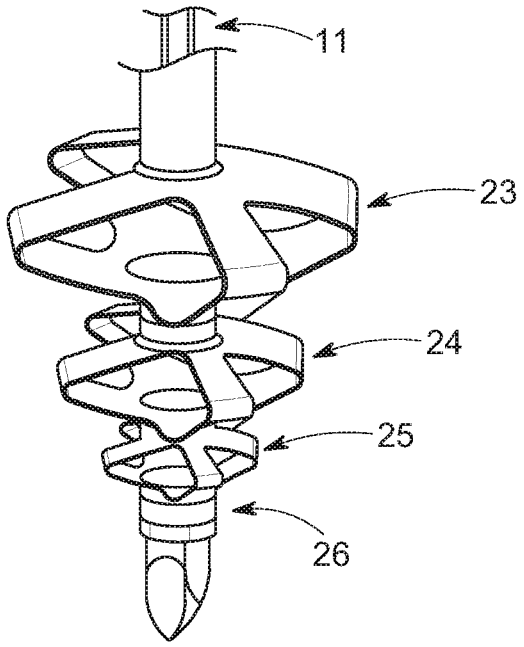
Figure 6C:
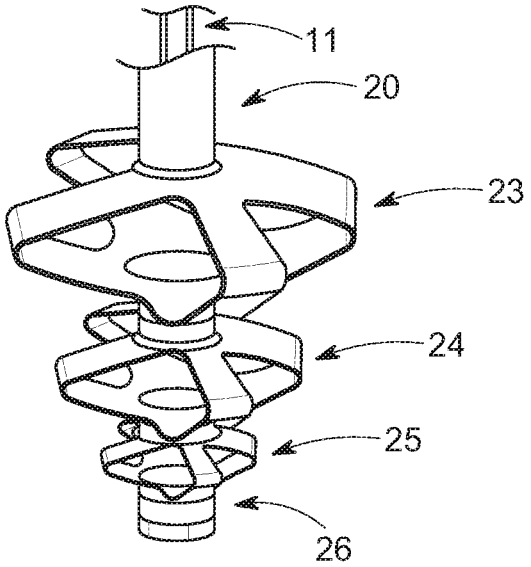

Turning now to FIGS. 6A-C, these figures show anchor deployment in relatively less dense soils than that shown in 4A-C and 5A-C. FIG. 6A starts with the level of deployment shown in FIG. 5B with crumple zones 25 and 24 deformed. In the softest soils, resistance against foundation component 20 is lower. As a result, the same amount of axial force on component 20 will result in longer crumple zone 23 ($L_3$) with its relatively narrow opening 23A splaying into the surrounding soil as the sections of the crumple zone fold about crumple lines 23B. This is shown in FIG. 6B where upward force on mandrel 11 combined with bracing on the top of component 20 deforms all three crumple zones 25, 24, 23, providing the largest underground orthogonal footprint. For a given amount of pulling force, crumple zone 23 deformation will only happen in the softest soils because of the relatively large size of the sections (one half of $L_3$). Soil resistance rather than the steel's rigidity is the controlling factor. In this way, the installer doesn't need to know the properties of the soil. Rather, the same compressive force will result in the appropriate crumple zones deploying to anchor foundation component 20 to the soil.

Though not shown, in various embodiments, zones 25, 24 and 23 may be offset from one another by misaligning the crumple zone openings so that when they are deformed, the crumple sections project out into the surrounding soil at different radial positions. For example, zone 25 may project out at 0, $\pi/2$, $\pi$, and $3\pi/2$ radians, zone 24 may project out at $\pi/6$, $2\pi/3$, $7\pi/6$, and $5\pi/3$ radians, and zone 23 may project out at $\pi/3$, $5\pi/6$, $4\pi/3$, and $11\pi/6$ radians. Offsetting the position of the crumple sections will reduce spatial redundancy which provides very little additional resistance to axial forces. Also, it should be appreciated that although each crumple zone in the Figures is shown having four crumple sections, in various embodiments each crumple zone may have more or fewer than four sections.

Figure 7A:
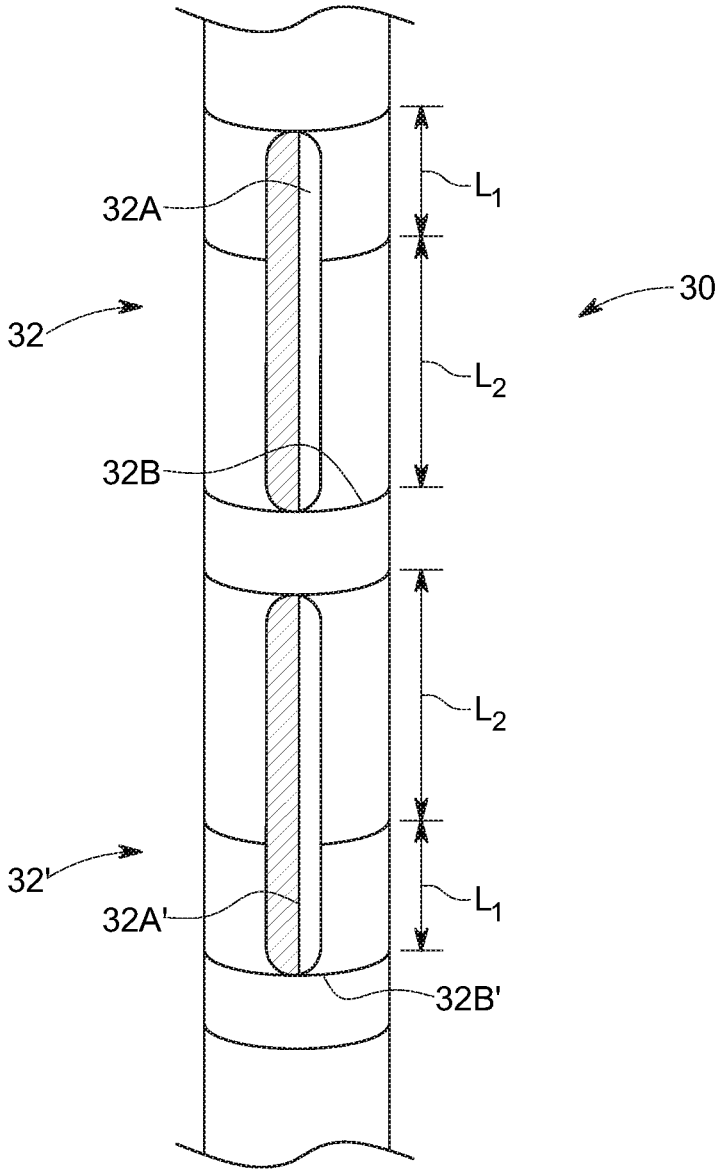
FIG. 7A shows a crumple zone portion of a foundation component according to various embodiments of the invention.
Figure 7B:
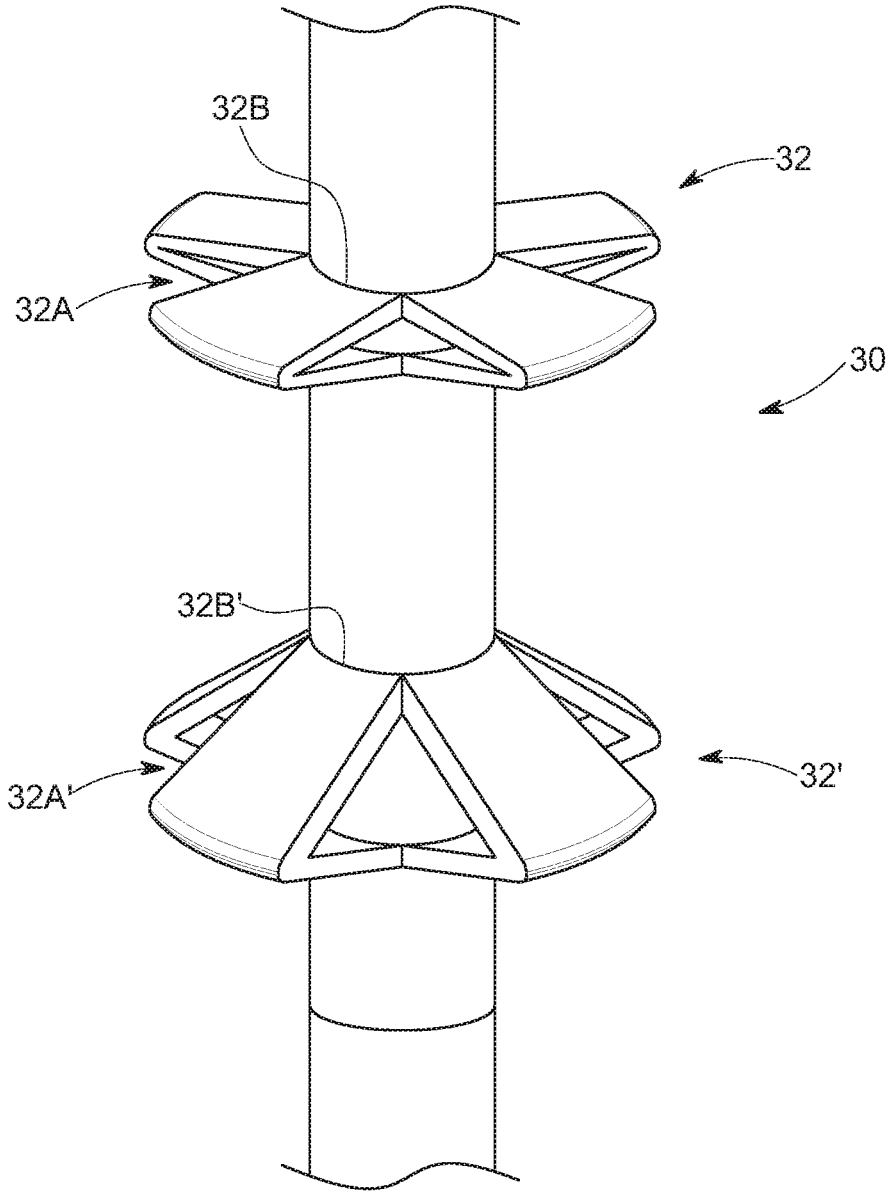
FIG. 7B shows the foundation component of 7A after anchor deployment.

Turning now to FIGS. 7A/B, these figures show another crumple zone geometry according to various embodiments of the invention. In the example of these figures, foundation component 30 has adjacent symmetric crumple zones 32/32' that are offset in opposing directions. In this context, offset refers to the fact that the middle crumple line does not bisect openings 32A/32A'. Rather, in upper crumple zone 32A, the line is relatively closer to the top of opening 32A and in lower crumple zone 32B', it is relatively closer to the bottom of opening 32A'. Crumple lines 32B/32B' are placed at the beginning and end of openings 32A/32A', and at distance $L_1$ from one end and $L_2$ from the opposing end. After a gap between them, this spacing is repeated in the opposite direction creating two adjacent crumple zones 32/32' that are symmetric to one another about the gap between them. Because crumple zones 32/32' are not divided into equal halves, they will deform unevenly causing the short section to fold back on itself as the long section folds out. As seen in 7B, upper crumple zone 32 deforms upward while lower one 32' deforms downward. Having one crumple zone pointing upward and one point downward may provide improved performance over the orthogonal crumple zones shown in FIGS. 3, 4 and 5. This may be due to small voids that are created above and below each crumple section when the zones deform. These voids could allow a small amount of axial movement before the crumple sections contact the earth above and below within the voids, assuming a force strong enough to overcome skin friction is applied to the strut.

Figure 8:
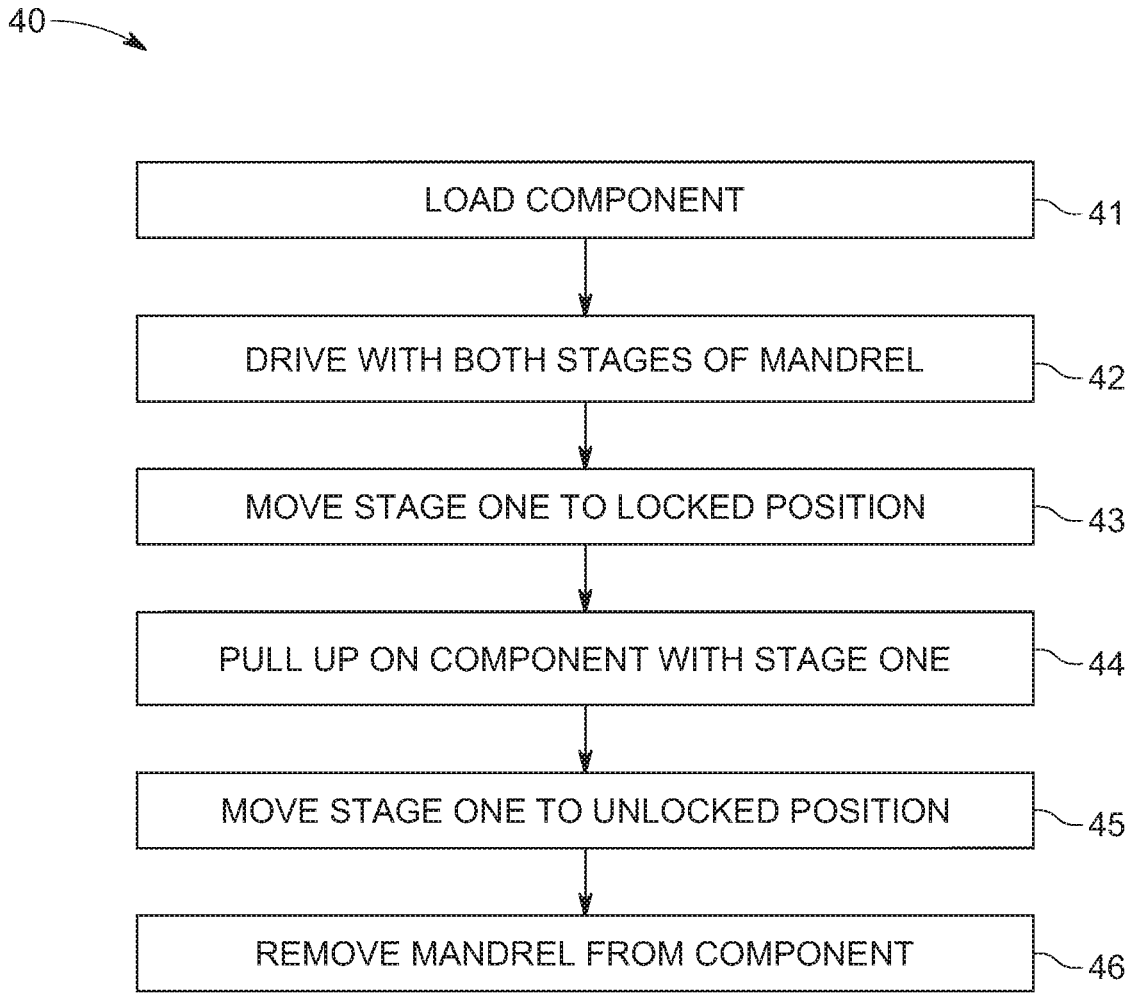
FIG. 8 is a flowchart detailing the steps of a method for installing and anchoring a foundation component according to various embodiments of the invention.

Turning to FIG. 8, this figure shows a flowchart detailing the steps of exemplary method 40 of installing and anchoring a foundation component according to various embodiments of the invention. Method 40 may be usable with any of the foundation components shown herein or with variants of these components. Method 40 begins at step 41 where the foundation component is loaded on to the mandrel. In various embodiments, this is accomplished by sleeving the component over the mandrel until the tip of the mandrel projects out of narrowed bottom end. In various embodiments, and as seen in 2B, the foundation component will slide over the mandrel until the mandrel's tip and the narrower collar portion exit the swaged opening. Then, in step 42, the foundation component is driven with the mandrel. As discussed herein, this may be accomplished by actuating the mandrel driver to begin pushing down or hammering, or by engaging an arm of an excavator or other equipment to push down on the mandrel driver and mandrel assembly, or, by combinations of these. In various embodiments, the mandrel will have two stages, the tipped portion that penetrates the foundation component, stage one, and the slide that supports the top end of the foundation component, stage two. In this step, the tip of the mandrel may be pushing against the swaged opening of the mandrel while the slide simultaneously pushes against or braces the top of the driven component. Once the assembly has reached the desired depth, in step 43, stage one of the mandrel is rotated to the locked position. In various embodiments, this may require pulling a pin, releasing a set screw or otherwise disengaging the foundation component from one or both stages of the mandrel. Also, as discussed above in the context of FIGS. 3A-E, it may be desirable to first pull up on the mandrel to ensure that the narrowed collar portion is positioned in the opening of the foundation component. It should be appreciated that in some embodiments it may be desirable to drive the foundation component in the locked position to eliminate a process step. Once the locked position is achieved, step 44 is performed where upward force is applied to the mandrel while the foundation component is braced from above, such as, for example, by the slide shown in the figures. In various embodiments, a predetermined amount of compressive pressure will be applied to the strut, regardless of the type of soil the strut is driven in to. This will cause one or more of the crumple zones formed proximate to the below-ground end of the strut to deform, deploying them into the surrounding earth. The degree of deformation (i.e., the number of crumple zones that are deformed) will depend on the soil density for a given amount of compressive force. In other embodiments, the force may be applied for a fixed amount of time and/or until a predetermined amount of movement occurs.

Once this process times out or ends, or another triggering event occurs, the pulling force is relaxed in step 45 and stage one of the mandrel is returned to the unlocked position. As discussed above, at this step a slight downward pressure may be applied to the mandrel to ensure that the collar reaches the swaged opening and the mandrel can be rotated and withdrawn from the anchored foundation component. Then, in step 46, the mandrel is withdrawn. In various embodiments, stage two (e.g., the slide) may continue to engage the top of the foundation component until stage one has cleared the lower end of the foundation component. The process is then repeated to install additional foundation components.

Figure 9A:
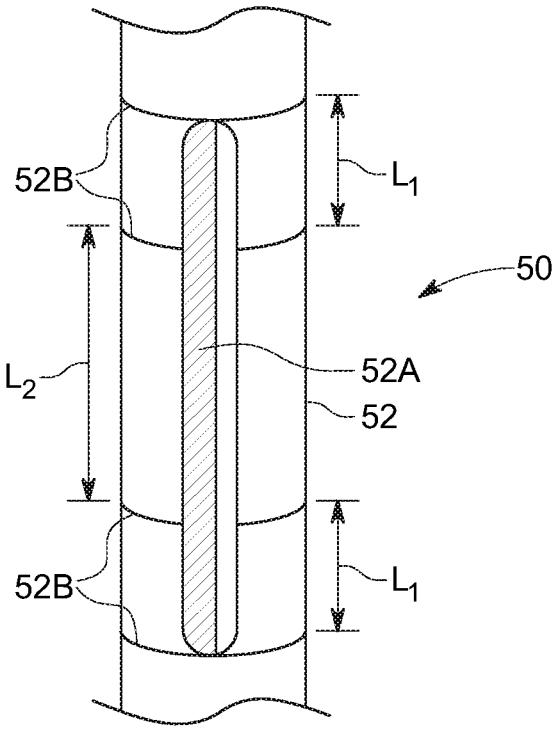
FIGS. 9A and B show pre and post deployment views of another foundation component according to various embodiments of the invention.
Figure 9B:
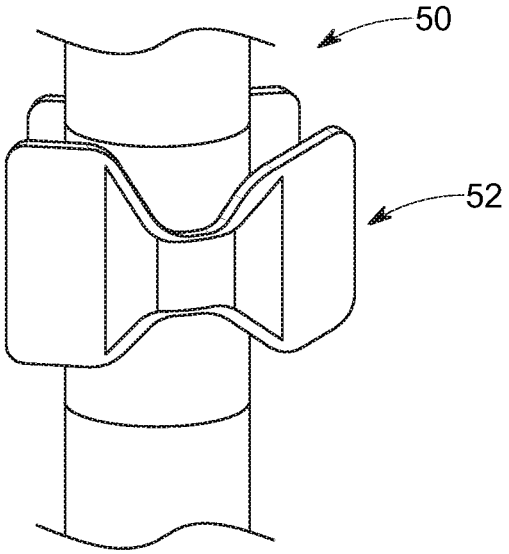

FIGS. 9A and B show another foundation component 50 according to various embodiments of the invention. The portion of foundation component 50 shown in these figures has crumple zone 52 divided into three sections having respective lengths $L_1$, $L_2$ and $L_1$. Deformation of crumple zone 52 will result in bow-tie shaped anchors 52 seen in 9B. Each section of the crumple zone having this configuration will deform into a relatively long flat section oriented parallel to the strut axis with two shorter, angled connecting sections as seen in 9B. These projections will provide increased resistance to both tensile and compressive forces on the foundation component.

Figure 10A:
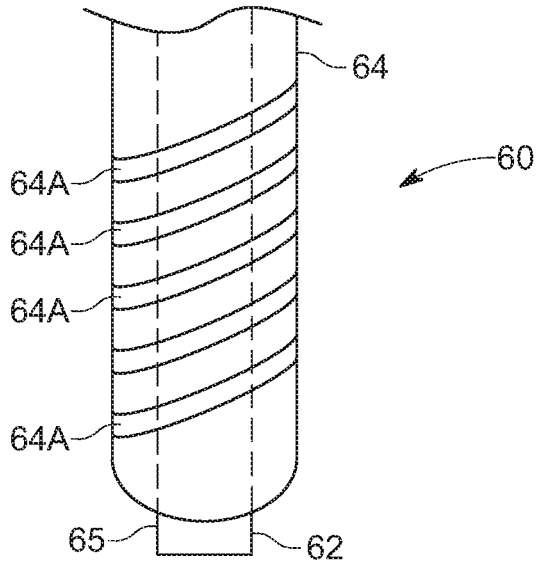
FIGS. 10A and B show pre and post deployment views of a further foundation component according to various embodiments of the invention.

In addition to the embodiments shown thus far, in various other embodiments, the mandrel may engage with a feature formed in the foundation component to deploy anchoring features through rotation. To that end, FIGS. 10A and B show a portion of another exemplary foundation component according to various embodiments of the invention. Component 60 shown in FIGS. 10A and B is an elongated strut that consists of a full-length inner portion 62 and an outer portion 64 enclosing a portion of inner strut 62 to form a sleeve around the latter. In various embodiments, outer strut may be joined to the inner strut at the distal below-ground end of the inner strut with a weld or other suitable bond. Also, in various embodiments, the portion of the outer strut proximate to the below-ground end of inner strut may be pre-distressed or formed with a plurality of cuts 64A, making it predisposed to deformation upon twisting.

In various embodiments, foundation component 60, including inner and outer portions 62, 64, will be driven into the ground using a mandrel or other suitable driving device until the desired depth is achieved. This may be accomplished through downward pressure, hammering, or a combination of these. In various embodiments, component 60 may be driven to the point where the upper end of outer portion 64 nearly reaches grade. In various embodiments, this point will be somewhere along the length of inner portion 62. In various embodiments, once the desired depth has been achieved, the mandrel used to drive component 60 will rotate inner portion 62 while the above-ground end of the outer portion 64 is held in place (i.e., prevented from rotating). In various embodiments, a fixed amount of twisting pressure may be applied for a predetermined time to deform the tip. In other embodiments, the mandrel may be spun a predetermined number of rotations or fractional rotations (e.g., $\pi/4$ radians). Once this has been achieved, the mandrel is pulled out leaving the anchored strut in place and the process repeats for the next strut in the array.

In various embodiments, rotation of inner portion 62 will tend to rotate the attached portion of the outer portion 64, unfolding it about cuts 64A, expanding its outside diameter as shown in 10B. This increased orthogonal surface area will have the effect of increasing the foundation component's resistance to axial forces (e.g., tension and compression). Although the degree to which this expansion occurs will be random and dependent on the speed and pressure of rotation as well as the density and condition of the soil surrounding the below-ground end, twisting of the inner portion 62 while holding the above-ground end of the outer portion 64 will cause some deformation below ground. In various embodiments, cuts 64A formed in the outer strut 64 are formed at diagonals with respect to component 60's main axis and angled in the direction of rotation to increase the extent to which outer strut 64 unfolds when torque is applied to the inner strut 62.

Figure 10B:
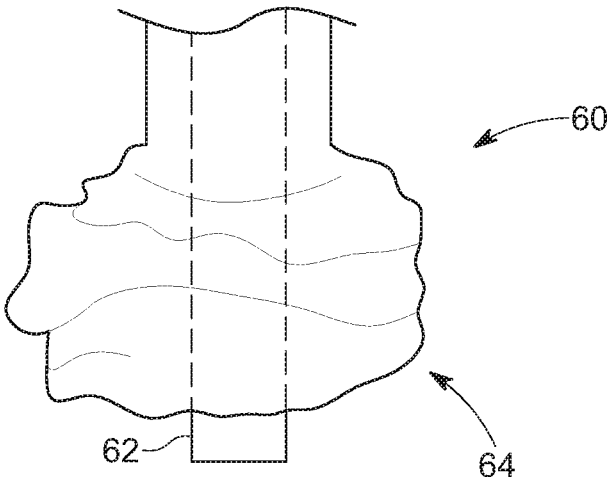

In various embodiments, during driving, a mandrel may engage with a bolt or other feature orthogonal to the strut's axis to push it into the ground as well as to rotate it. In other embodiments, inner portion 62 may be solid and this driving feature may be formed in the above-ground end. In such cases, downward pressure will drive component 60 while rotation of the mandrel while holding outer portion 64 will unfold the outer portion 64 at cuts 64A. This will also result in the end of the strut deforming to a larger diameter shape such as that shown in FIG. 10B. The larger diameter shape at or near the deepest point below ground will increase the strut's resistance to axial forces for compression and tension.

Figure 11A:
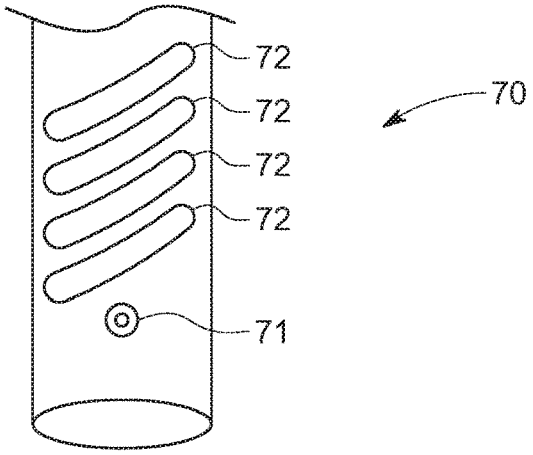
FIGS. 11A-C show different views of an additional foundation component according to various embodiments of the invention.
Figure 11B:
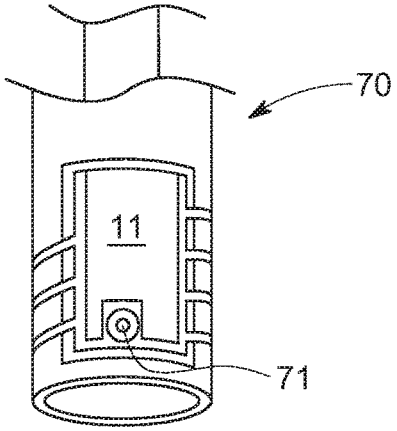
Figure 11C:
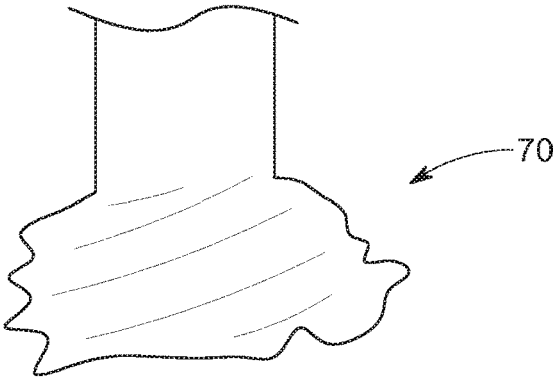

Referring now to FIGS. 11A-C, these figures show another exemplary foundation component 70 according to various additional embodiments of the invention. As with component 60 shown in FIGS. 2A-C, exemplary component 70 is formed from an elongated section of rounded pipe or tube. Instead of features deployed by compression, component 70 has driving pin 71 proximate to the lower (e.g., below-ground) end. In various embodiments, driving pin 71 provides a connection point for the mandrel to drive foundation component 70 into the ground and to apply torque. Driving is accomplished by sleeving component 70 over a mandrel 11 until the notch formed in mandrel 11 receives driving pin 71. This enables the mandrel to drive component 70 at least partially from below and also provides a non-locking mechanism for the mandrel to rotate component 70 about its primary axis after it is driven to depth. As seen in FIG. 11A, a series of cuts 72 may be formed proximate to the lower end.

Installation and anchor deployment are accomplished by driving component 70 into the ground at the desired location by applying downward axial force from mandrel 11 or a piece of equipment the mandrel is attached to. In addition to the configuration shown in 11B, in various other embodiments the end of mandrel 11 may extend to a pair of points (not shown) with a notch in between to receive pin 71. This may prevent dirt from plugging component 70 and reduce the required downforce to drive component 70. When component 70 has been driven to the desired depth, mandrel 11 is rotated, taking the lower end of component 70 with it, while holding the above-ground end in place via a pin or other connection. This will result in the below-ground end of component 70 unraveling to some extent, increasing its outside diameter which in turn will increase its resistance to axial forces of compression and tension. The degree to which it unfolds will be a function of the applied rotational force, the thickness of the metal, and the density of the surrounding soil. For a given force and thickness, denser soils will limit the extent of deformation relative to less dense soils.

FIG. 11B is a partial cut-away view revealing the connection between mandrel 11 and driving pin 71. In this example, mandrel 11 has a notched tip that transversely receives pin 71. In various embodiments, component 70 and mandrel 11 are dimensioned so that when component 70 is slid on to mandrel 11, pin 71 will sit in the notch simultaneous to the slide of mandrel 11 contacting the top end of component 70. This will allow component 70 to be pushed from both ends simultaneously. In still further embodiments, the pushing force may be applied to pin 71 only. After the desired driving depth is achieved, mandrel 11 is rotated while the top of component 70 is held in place. In various embodiments, this will cause component 70 to unravel about cuts or distress lines 72 so that it anchors into the surrounding soil. The enlarged outside diameter will help the component 70 resist axial forces.

Those of ordinary skill in the art will appreciate that although the figures show only a single foundation component in isolation in various embodiments, two or more foundation component may be used together in an adjacent fashion to form an integrated foundation. Moreover, foundation components according to the various embodiments of the invention may be driven plumb or may be driven at angles, whether a single component is used, or two or more adjacent components are used together. Such variations are within the scope of the invention. Also, foundation components may be used to support a number of different structures including fixed tilt and single-axis tracker solar arrays, signs, fence posts, and other structures. The various embodiments of the invention are not tied to any particular application.

The embodiments of the present inventions are not to be limited in scope by the specific embodiments described herein. Indeed, various modifications of the embodiments of the present inventions, in addition to those described herein, will be apparent to those of ordinary skill in the art from the foregoing description and accompanying drawings. Thus, such modifications are intended to fall within the scope of the following appended claims. Further, although some of the embodiments of the present invention have been described herein in the context of a particular implementation in a particular environment for a particular purpose, those of ordinary skill in the art will recognize that its usefulness is not limited thereto and that the embodiments of the present inventions can be beneficially implemented in any number of environments for any number of purposes. Accordingly, the claims set forth below should be construed in view of the full breath and spirit of the embodiments of the present inventions as disclosed herein.

The invention claimed is:

1. An expanding foundation member comprising:

an elongated open shaft having a first end and an opposing second end, wherein the first end comprises an opening dimensioned to pass a portion of a driving tool at one orientation and to capture the driving tool at a second orientation; and a plurality of successive crumple zones beginning proximate to the first end that are deployed after driving the foundation member by pulling on the driving tool while at the second orientation, wherein each of the plurality of successive crumple zones increases in length moving towards the second end.

2. The expanding foundation member according to claim 1, wherein each crumple zone comprises adjacent openings in the surface of the shaft, each opening beginning at a common distance from the first end and extending a uniform distance along the shaft.

3. The expanding foundation member according to claim 2, further comprising transverse crumple lines proximate to the beginning and end of each opening and connecting each adjacent opening at an approximate midpoint, wherein compression of the first end of the shaft towards the second end causes the member to deform orthogonally about the crumple lines thereby widening a cross section of the foundation member.

4. The expanding foundation member according to claim 3, wherein causing the member to deform comprises causing the shaft to fold substantially about the plurality of crumple lines.

5. The expanding foundation member according to claim 1, wherein a number of crumple zones deformed in response to a given compressive force is dictated by a resistance of the supporting medium surrounding the foundation member.

6. An assembly for forming a foundation member comprising:

a mandrel having an elongated shaft, a collar portion and a tip portion; and an elongated hollow foundation member, the foundation member having a first end and an opposing second end, the first end comprising an opening dimensioned to pass the tip portion of the mandrel when the mandrel is at a first orientation and to capture the tip portion when the mandrel is at a second orientation, the foundation member further comprising a plurality of successive crumple zones extending away from the first end, wherein the crumple zones have different lengths.

7. The assembly according to claim 6, wherein each crumple zone comprises a plurality of openings and a plurality of corresponding crumple lines, wherein each opening extends along a main axis of the foundation member and each crumple line is orthogonal to the main axis.

8. The assembly according to claim 6, wherein pulling on the mandrel when the mandrel is at the second orientation causes at least one of the plurality of crumple zones to deform.

9. An expanding underground foundation component comprising:

an elongated body having a first end and an opposing second end, wherein the first end comprises an opening dimensioned to pass a portion of an installation tool at a first orientation and to capture the portion of the installation tool at a second orientation; and an expending portion proximate to the first end, the expanding portion capable of transversely extending a portion of the elongated body into supporting ground when the tool is pulled against the first end while at the second orientation; wherein the expanding portion of the foundation component comprises at least one crumple zone.

10. The expanding foundation component according to claim 9, wherein the at least one crumple zone comprises a plurality of adjacent openings and a plurality of corresponding crumple lines, wherein each opening extends along a main axis of the foundation member and each crumple line is orthogonal to the main axis.

* * * * *